United States Patent [19]

Schieman et al.

[11] 4,234,409

[45] Nov. 18, 1980

[54] PROCESS FOR THE PRODUCTION OF LUBRICATING BLEND STOCKS

[75] Inventors: Richard D. Schieman, Rocky River; John H. Steffens, Lynhdurst, both of Ohio

[73] Assignee: Standard Oil Company, Cleveland, Ohio

[21] Appl. No.: 16,046

[22] Filed: Feb. 28, 1979

[51] Int. Cl.[3] ..... C10G 71/00; C10G 73/02

[52] U.S. Cl. ..... 208/28; 208/18; 208/19

[58] Field of Search ..... 208/18, 19, 96, 28

[56] References Cited

U.S. PATENT DOCUMENTS

| | | | |
|---|---|---|---|
| 2,780,581 | 2/1957 | Macke et al. | 208/19 |
| 3,660,273 | 5/1972 | Cummins | 208/18 |
| 3,684,684 | 8/1972 | Coleman et al. | 208/18 |
| 3,723,295 | 3/1973 | Kress | 208/18 |
| 3,915,871 | 10/1975 | Bryer et al. | 208/19 |

*Primary Examiner*—Herbert Levine

*Attorney, Agent, or Firm*—John E. Miller, Jr.; Herbert D. Knudsen; Larry W. Evans

[57] ABSTRACT

In the production of lubricating oil blend stocks obtained by the distillation, extraction, dewaxing and clay contacting of atmospheric crude distillation column residue, the improvement comprising using a hydrogenated gas oil to supplement the atmospheric crude distillation column residue feedstock.

6 Claims, 2 Drawing Figures

1.

2.

PROCESS FOR THE PRODUCTION OF LUBRICATING BLEND STOCKS

BACKGROUND OF THE INVENTION

In the production of lubricating oil blend stocks, crude oil is first fractionated in an atmospheric distillation column. The residue of crude oil that is left after the removal of the light ingredients in the crude oil, e.g. straightrun gasoline, kerosene and gas oil, is the basic charge stock for lubricating oil blend stock manufacture. Even though less than 2% of the total crude oil refined in the United States is converted to lubricants, the value of lubricating oil blend stocks makes lubricant manufacture an important part of crude oil refining.

FIG. 1 is a schematic drawing of a conventional facility for making lubricating oil blend stocks. Crude oil is fractionated in atmospheric distillation column 1, and straightrun gasoline, kerosene and gas oil are removed as sidestream cuts from lines A, B and C, respectively. The residue of this crude oil is passed via line 2 into vacuum distillation column 3, where it is vacuum fractionated. The overhead from this fractionation, i.e. gas oil, is taken via line 4 to another part of the refinery, while the liquid bottoms are taken through line 10 to still another part of the refinery. Various lubricating oil blend stock precursors are taken as sidestream cuts and conveyed from vacuum distillation column 3 to storage via lines 5 through 9.

In the next step of the process, the various lubricating oil blend stock precursors are subjected to extraction, dewaxing and clay contacting. This is accomplished by sequentially passing the individual lubricating oil blend stock precursors via line 11 from storage to extraction unit 12, then to dewaxing unit 14 and then to clay contacting unit 16. In extraction unit 12 the lubricating oil blend stock precursors are dearomatized, while in dewaxing unit 14 the wax is separated from the extracted oil and finally in clay contacting unit 16 the oil is decolorized. The resultant lubricating oil fractions are then conducted through line 17 to storage tanks to await blending.

There are several known disadvantages with the lubricating oil blend stocks of the prior art. First, some of the hydrocarbons suitable for making up the lubricating oil blend stock precursors, which should be recovered in sidestreams 5 to 9 of the vacuum distillation column, remain in the vacuum distillation column bottoms and hence are not recovered for use in making lubricating blend stocks. Second, the demand for lubricating blend stocks often exceeds the amount of atmospheric crude oil residue feedstock available.

Accordingly, it is an object of the present invention to provide a modified process for producing lubricating oil blend stocks in which the loss of lubricating oil blend stock precursors from the vacuum tower bottoms is significantly reduced. In addition, it is a further object of the present invention to provide an additional feedstock which is useful in the production of lubricating oil blend stocks.

SUMMARY OF THE INVENTION

In accordance with the present invention, these and other objects are accomplished by using as part of the feed to vacuum distillation column 3 a stream comprising a hydrogenated gas oil having a specific set of properties.

Thus, it has now been found that when the feed to the vacuum distillation column of a lubricating oil plant contains hydrogenated gas oil, the hydrogenated gas oil acts as a hydrocarbon stripping medium and strips hydrocarbons suitable for making up the lubricating oil blend stock precursors from the tower bottoms in the vacuum distillation column. As a result, more lubricating oil blend stock precursors are recovered in sidestreams 5 to 9 per barrel of crude oil than are now obtained using prior art methods.

Thus, the present invention provides a process for the production of lubricating oil blend stocks in which a refinery stream comprising an atmospheric distillation column residue is vacuum distilled, extracted and dewaxed; the improvement comprising including in said refinery stream a hydrogenated gas oil having at least 80% boil off in the range of 500° F. to 1200° F.

BRIEF DESCRIPTION OF THE DRAWING

FIG. I is a schematic view of a facility for manufacturing lubricating oil blend stocks.

FIG. II is a schematic view of a facility for hydrocracking gas oil.

DETAILED DESCRIPTION

Figure 1:
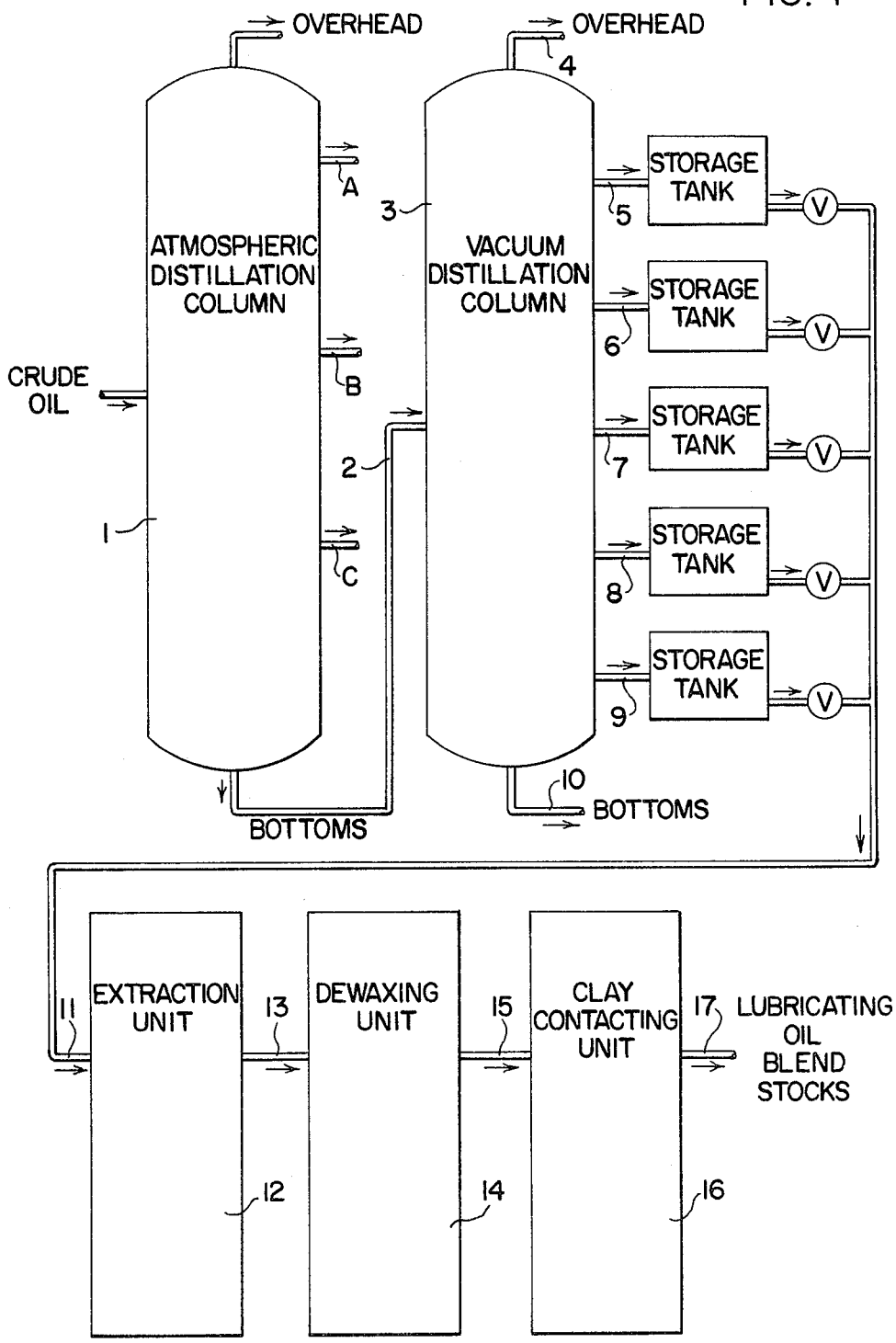
Figure 2:
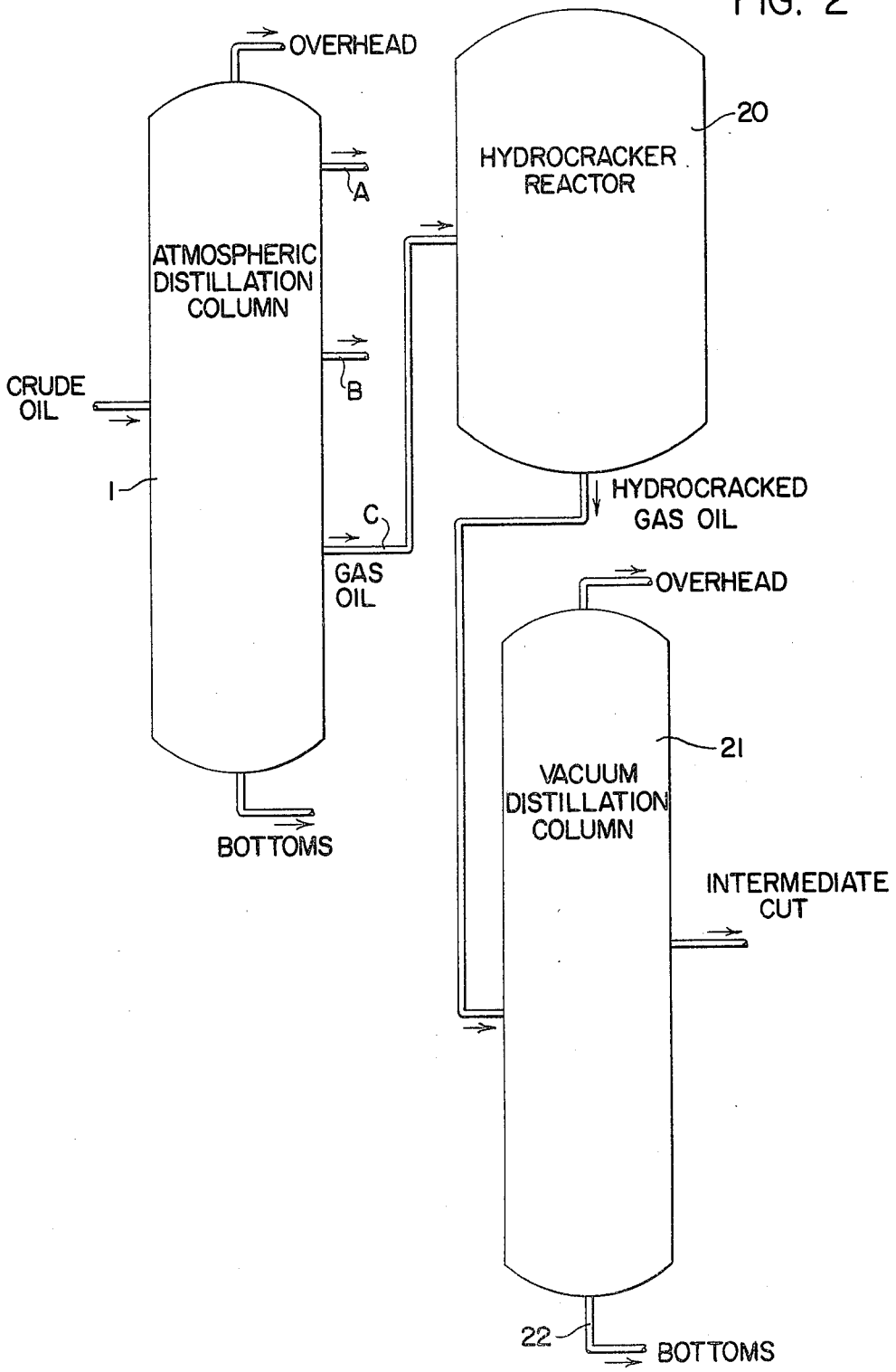

In accordance with the present invention, hydrogenated gas oil is used to supplement the crude oil atmospheric distillation column residue feedstock in a facility for producing lubricating oil blend stocks. As indicated above, lubricating oil blend stocks have been produced for many years using atmospheric distillation column residue as the feedstock. The instant invention modifies this prior art process by introducing a hydrogenated gas oil into the feedstock.

The hydrogenated gas oil used to supplement or replace the atmospheric distillation column residue feedstock to a lubricating oil plant is derived from a specific cut of a distillation column. As is well known in the art of crude oil refining, crude oil is normally fractionated in an atmospheric distillation column into a top, bottom and one or more intermediate cuts. (See *Kirk-Othmer's Encyclopedia of Chemical Technology*, Volume 15, Pages 13 thru 61 (Second Edition 1968)). In making the hydrogenated gas oil feedstock of the invention, the gas oil intermediate cut is treated with hydrogen in a conventional hydrocracking unit.

FIG. II shows this process in more detail. As discussed above, the crude oil is fed into distillation column 1 where it is fractionated into bottoms, overhead and intermediate cuts A, B and C, e.g. gasoline, kerosine and gas oil. Gas oil, intermediate cut C, is conveyed to hydrocracker reactor 20 where the gas oil is treated with hydrogen. Thereafter, the hydrogenated gas oil is fed to vacuum fractionation unit 21 where the hydrogenated gas oil is separated into a number of fractions, i.e. overhead, bottoms and one or more intermediate fractions, the bottoms fraction, line 22, having at least 80% boil off in the range of 500° to 1200° F. This bottoms fraction is the hydrogenated gas oil material used to supplement the atmospheric distillation column residue feedstock to a lubricating oil plant.

A preferred embodiment of the present invention comprises using a hydrogenated gas oil wherein at least 90% boils off in the range of 700° to 1100° F.

Techniques for hydrocracking have been extensively discussed in the literature. For example, see "The Continuing Development of Hydrocracking", *Origin and Refining of Petroleum* (*Advances in Chem Series* 103), Page 113 (1970) and *Kirk-Othmer's Encyclopedia of Chemical Technology, Supra.*, Pages 15 and 45 thru 54. These articles provide the general background upon which the instant invention builds.

The addition of any amount of hydrogenated gas oil to the atmospheric crude oil residue feedstock results in improved yields of lubricating oil blend stocks. However, commercial operation constraints dictate that the feedstock contain between 0.5% and 95% by volume hydrogenated gas oil. Preferably this feedstock contains between 0.5% and 50% by volume hydrogenated gas oil and most preferably the feedstock contains 1% to 30% hydrogenated gas oil.

Once the hydrogenated gas oil is introduced into vacuum distillation column 3 the production of various lubricating oil blend stock precursors in accordance with the present invention is carried out in exactly the same way as in the prior art, the only difference being that increased yields of lubricating oil blend stock precursors are realized. These increased yields probably result from the fact that the supplemented feedstock has a lower viscosity than the unsupplemented feedstock. This lower viscosity results in favorable changes in the liquid-vapor balance within the vacuum distillation column. Furthermore, the lower viscosity of the supplemented reduced crude feedstock makes it possible to either obtain a fixed boiling range lubricating blend stock precursor with a lower viscosity than obtainable with prior art methods or a fixed viscosity lubricating blend stock precursor with a higher boiling range than obtainable with prior art methods.

In a modification of the inventive process, the atmospheric distillation column residue, rather than being fractionated and then extracted as shown in FIG. I, is together with the hydrogenated gas oil first extracted and then subjected to vacuum distillation.

The lubricating blend stocks produced by the instant invention are blended to form a component of the oil used to lubricate the engines of passenger cars, trucks, buses, and motorcycles.

In order to more thoroughly illustrate the present invention, the following examples are presented.

EXAMPLE 1

A feed comprising 1% hydrogenated gas oil, 90% boiling off in the range of 700° to 1100° C., and 99% atmospheric distillation column residue was fed into vacuum atmospheric distillation column 3 of FIG. I. The feed rate was 28,000 barrels per day. The yields of the various vacuum distillation sidestreams (streams 5 thru 9 in FIG. I) are set forth in Table I.

COMPARATIVE EXAMPLE A

The procedure of Example 1 was followed except that the feed comprised 100% atmospheric distillation column residue. The results are reported in Table I.

TABLE I

VACUUM DISTILLATION COLUMN SIDESTREAM YIELDS BASED ON CRUDE CHARGE RATE 28,000 Barrels Per Day Crude Rate

| | | % Sidestream Yields | | | | | |
|---|---|---|---|---|---|---|---|
| Example | Feed | Lt PD[1] | PD[2] | ID[3] | VCS[4] | HCS[5] | Total |
| 1 | 99% Atmospheric Distillation Column Residue 1% Hydrogenated Gas Oil | 3.44 | 4.17 | 7.84 | 5.88 | 1.22 | 22.55 |
| A | 100% Atmospheric Distillation Column Residue | 3.31 | 4.56 | 6.16 | 6.09 | 1.07 | 21.19 |

[1]Stream #5 in FIG. I (light paraffin distillate)
[2]Stream #6 in FIG. I (paraffin distillate)
[3]Stream #7 in FIG. I (intermediate distillate)
[4]Stream #8 in FIG. I (vacuum cylinder stock)
[5]Stream #9 in FIG. I (heavy cylinder stock)

It is clear from Table I that there is a net increase in sidestream yields of vacuum distillation column 3 when the feed contains some hydrogenated gas oil. In this regard, the yields of light paraffin distillate, intermediate distillate and heavy cylinder stock are increased while yields of paraffin distillate and vacuum cylinder stock are decreased when hydrogenated gas oil is added to the feed. Overall there is a net increase of 1.36%. Thus, even though the feed of Example 1 contained only 277 barrels per day of hydrogenated gas oil there was a net increase in sidestream yields of 380 barrels per day. This unexpected increase in sidestream yields resulted from the hydrogenated gas oil acting as a hydrocarbon stripping medium and stripping hydrocarbons suitable for making up the lubricating oil blend stock precursors from the vacuum distillation column bottoms.

Although only a few embodiments of the present invention have been specifically described, it should be appreciated that many additions and modification can be made without departing from the spirit and scope of the invention. For example, although each facility for producing lubricating blend stock may be constructed and operated under slightly different conditions, it is well within the ability of one skilled in the art to apply this invention to any of these plants. These and all other modifications are intended to be included within the scope of the present invention, which is to be limited only by the following claims:

We claim:

1. In a process for the production of lubricating oil blend stocks in which a refinery stream comprising an atmospheric distillation column residue is vacuum distilled, extracted and dewaxed; the improvement comprising including in said refinery stream a hydrogenated gas oil having at least 80% boil off in the range of 500° to 1200° F.

2. The process of claim 1 wherein the hydrogenated gas oil has at least 90% boil off in the range of 700° to 1000° F.

3. The process of claim 1 wherein said refinery stream contains between 0.5% and 50% hydrogenated gas oil.

4. The process of claim 1 wherein said refinery stream contains between 1% and 30% hydrogenated gas oil.

5. The process of claim 1 in which the refinery stream is first vacuum distilled and then extracted.

6. The process of claim 1 in which the refinery stream is first extracted and then vacuum distilled.

* * * * *